US008632300B2

(12) United States Patent
Rogers et al.

(10) Patent No.: US 8,632,300 B2
(45) Date of Patent: Jan. 21, 2014

(54) ENERGY ABSORBING APPARATUS IN A GAS TURBINE ENGINE

(75) Inventors: Friedrich Rogers, West Palm Beach, FL (US); Yevgeniy Shteyman, West Palm Beach, FL (US)

(73) Assignee: Siemens Energy, Inc., Orlando, FL (US)

( * ) Notice: Subject to any disclaimer, the term of this patent is extended or adjusted under 35 U.S.C. 154(b) by 1018 days.

(21) Appl. No.: 12/841,291

(22) Filed: Jul. 22, 2010

(65) Prior Publication Data

US 2012/0020770 A1 Jan. 26, 2012

(51) Int. Cl.
*F01D 5/10* (2006.01)

(52) U.S. Cl.
USPC ..... 415/119

(58) Field of Classification Search
USPC ..... 415/119, 191, 211.2, 213.1, 214.1, 220
See application file for complete search history.

(56) References Cited

U.S. PATENT DOCUMENTS

| | | | | |
|---|---|---|---|---|
| 1,998,951 | A | 4/1935 | Downer | |
| 4,889,470 | A | 12/1989 | Scalzo | |
| 4,934,899 | A * | 6/1990 | Patacca | 415/9 |
| 5,022,818 | A | 6/1991 | Scalzo | |
| 5,586,864 | A | 12/1996 | Knorowski et al. | |
| 5,788,456 | A | 8/1998 | Maier | |
| 6,929,453 | B2 | 8/2005 | Kite et al. | |
| 6,969,239 | B2 * | 11/2005 | Grant et al. | 416/220 R |
| 7,008,170 | B2 | 3/2006 | Proveaux et al. | |
| 7,101,150 | B2 * | 9/2006 | Bash et al. | 415/191 |
| 7,179,052 | B2 | 2/2007 | Sasaki et al. | |
| 7,645,117 | B2 * | 1/2010 | Bracken et al. | 415/173.3 |
| 8,096,746 | B2 * | 1/2012 | Durocher et al. | 415/1 |
| 2003/0103845 | A1 * | 6/2003 | Hamlin et al. | 415/191 |

OTHER PUBLICATIONS

Christian Hansen et al.; U.S. Appl. No. 11/654,353; filed Jan. 17, 2007; entitled "A Gas Turbine Engine".

* cited by examiner

*Primary Examiner* — Nathaniel Wiehe
*Assistant Examiner* — Woody A Lee, Jr.

(57) ABSTRACT

A gas turbine includes a casing, a first diaphragm assembly, a second diaphragm assembly, and first energy absorbing apparatus. The casing has a radially outer surface and a radially inner surface including an annular slot extending circumferentially therein. The first diaphragm assembly includes a first inner structure, a first outer structure and a plurality of airfoils extending between the first inner and outer structures. The second diaphragm assembly includes a second inner structure, a second outer structure and a plurality of airfoils extending between the second inner and outer structures. The first energy absorbing apparatus engages a first end portion of the first outer structure so as to absorb at least portions of unsteady aerodynamic loads and steady rotational loads generated by the first diaphragm assembly.

20 Claims, 6 Drawing Sheets

ENERGY ABSORBING APPARATUS IN A GAS TURBINE ENGINE

FIELD OF THE INVENTION

The present invention relates to a gas turbine engine, and more particularly, to an energy absorbing apparatus used with a vane segment in a gas turbine engine.

BACKGROUND OF THE INVENTION

A turbine engine includes a compressor typically comprising a plurality of axial stages, which compress airflow in turn. A typical axial compressor includes a split outer casing having two 180 degree halves, which are suitably bolted together. The casing includes rows of axially spaced apart casing slots which extend circumferentially for mounting respective vane segments.

A typical vane segment includes a pair of 180 degree diaphragm assemblies, each diaphragm assembly comprising radially outer and inner shrouds between which are attached a plurality of circumferentially spaced apart airfoils. The outer shroud includes a pair of axially spaced apart hook elements. The casing includes complementary first and second axially spaced apart grooves, which extend circumferentially within each of the casing slots for receiving the corresponding hook elements in a tongue-and-groove mounting arrangement.

During assembly, the individual diaphragm assemblies are circumferentially inserted into respective ones of the casing halves by engaging the hook elements with the corresponding grooves. Each diaphragm assembly is slid circumferentially in turn into its casing slot. The two casing halves are then assembled together so that the diaphragm assemblies in each casing slot define a respective annular vane segment for each compression stage. In this configuration, the individual diaphragm assemblies are mounted to the outer casing solely by their outer shrouds, with the airfoils and inner shrouds being suspended therefrom.

During operation of the compressor, each vane segment experiences stage differential pressure and airflow impingement, resulting in longitudinal, circumferential, and radial loads being transferred to and through the hook elements of the diaphragm assembly. Those steady loads are combined with pulsating blade-passing aerodynamic excitation loads, which cause the airfoils and outer shrouds of the diaphragm assemblies to vibrate. The vibrations in the outer shrouds cause the hook members to move within the corresponding grooves. Such movement results in frictional wear between the outer shrouds and the engine casing, which wear reduces part life.

SUMMARY OF THE INVENTION

In accordance with a first aspect of the present invention, a gas turbine is provided comprising a casing, a first diaphragm assembly, a second diaphragm assembly, and first energy absorbing apparatus. The casing has a radially outer surface and a radially inner surface comprising an annular slot extending circumferentially therein. The first diaphragm assembly comprises a first inner structure, a first outer structure and a plurality of airfoils extending between the first inner and outer structures. The second diaphragm assembly comprises a second inner structure, a second outer structure and a plurality of airfoils extending between the second inner and outer structures. The first energy absorbing apparatus engages a first end portion of the first outer structure so as to absorb at least portions of unsteady aerodynamic loads and steady rotational loads generated by the first diaphragm assembly.

The first energy absorbing apparatus may comprise a first spring support coupled to the first end portion of the first outer structure of the first diaphragm assembly, a second spring support coupled to a second end portion of the second outer structure of the second diaphragm assembly, and first spring structure positioned between the first and second spring supports.

The gas turbine may further comprise a second energy absorbing apparatus comprising a third spring support coupled to a second end portion of the first outer structure of the second diaphragm assembly, a fourth spring support coupled to a first end portion of the second outer structure of the second diaphragm assembly, and second spring structure positioned between the third and fourth spring supports.

The first energy absorbing apparatus may further comprise a spring support plate coupled to the second spring support of the first energy absorbing apparatus, the spring support plate abutting the casing to prevent rotation of the first energy absorbing apparatus within the annular slot.

The casing may comprise first and second casing halves, the spring support plate abutting a first end portion of the second casing half.

The first energy absorbing apparatus may be disposed within the slot in the compressor casing.

The first energy absorbing apparatus may substantially prevent the first end portion of the first outer structure of the first diaphragm assembly from contacting the second end portion of the second outer structure of the second diaphragm assembly.

In accordance with a second aspect of the present invention, a gas turbine is provided comprising a casing, a first diaphragm assembly, a second diaphragm assembly, first energy absorbing apparatus, and second energy absorbing apparatus. The casing has a radially outer surface and a radially inner surface comprising an annular slot extending circumferentially therein. The first diaphragm assembly comprises a first inner structure, a first outer structure and a plurality of airfoils extending between the first inner and outer structures. The second diaphragm assembly comprises a second inner structure, a second outer structure and a plurality of airfoils extending between the second inner and outer structures. The first energy absorbing apparatus engages a first end portion of the first outer structure so as to absorb at least portions of unsteady aerodynamic loads and steady rotational loads generated by the first diaphragm assembly. The second energy absorbing apparatus engages a first end portion of the second outer structure so as to absorb at least portions of unsteady aerodynamic loads and steady rotational loads generated by the second diaphragm assembly.

The gas turbine may further comprise a first spring support plate coupled to the second spring support of the first energy absorbing apparatus, the spring support plate abutting the casing to prevent rotation of the first energy absorbing apparatus within the annular slot.

The gas turbine may yet further comprise a second spring support plate coupled to the first spring support of the second energy absorbing apparatus, the second spring support plate abutting the casing to prevent rotation of the second energy absorbing apparatus within the annular slot.

In accordance with a third aspect of the present invention, a gas turbine is provided comprising a casing, a first diaphragm assembly, a second diaphragm assembly, and first energy absorbing apparatus. The casing has a radially outer surface and a radially inner surface comprising an annular slot extending circumferentially therein. The first diaphragm assembly comprises a first inner structure, a first outer structure and a plurality of airfoils extending between the first inner and outer structures. The second diaphragm assembly comprises a second inner structure, a second outer structure and a plurality of airfoils extending between the second inner and outer structures. The first energy absorbing apparatus engages a first end portion of the first outer structure so as to absorb at least portions of unsteady aerodynamic loads and steady rotational loads generated by the first diaphragm assembly. The first energy absorbing apparatus comprises a first spring support coupled to the first end portion of the first outer structure of the first diaphragm assembly, a second spring support coupled to a second end portion of the second outer structure of the second diaphragm assembly, and first spring structure positioned between the first and second spring supports.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
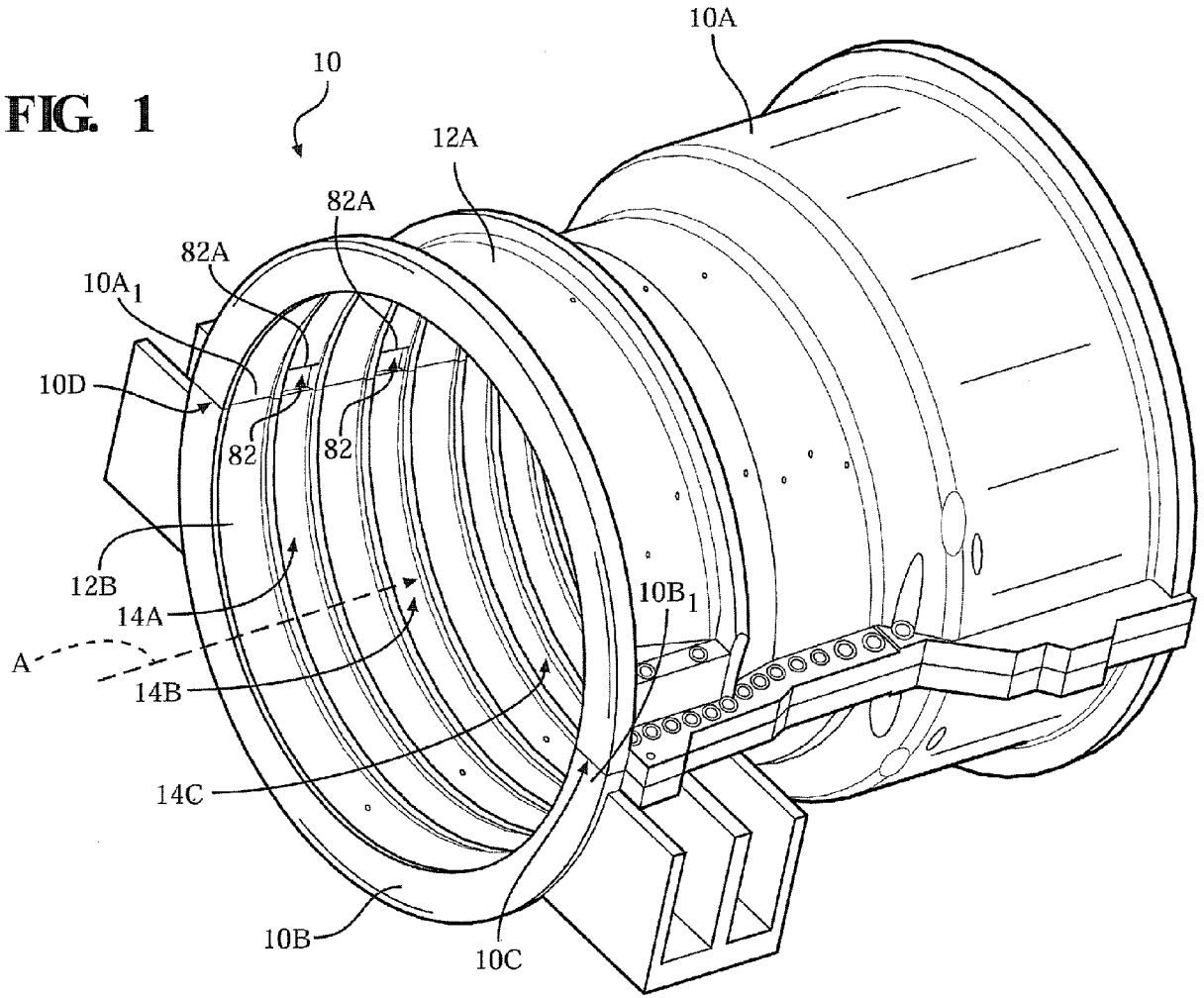
FIG. 1 is a perspective view of a casing of a turbine engine formed in accordance with the present invention.

FIG. 1 illustrates an outer casing 10 of a gas turbine engine. The outer engine casing 10 comprises first and second 180 degree casing halves 10A and 10B, joined together along first and second axial splitlines 10C and 10D via fasteners, such as bolts (not shown). The casing 10 includes a radially outer surface 12A and a radially inner surface 12B, and includes a plurality of axially spaced apart annular casing slots formed in the inner surface 12B. The casing slots extend circumferentially for mounting respective vane segments 20, as will be discussed herein. It is noted that only the first, second, and third casing slots 14A-14C are designated in FIG. 1 for mounting respective first, second, and third vane segments 20. However, the invention described herein can be applied to any number of static airfoil stages in a gas turbine engine, i.e. it is not limited to the vane segments 20 corresponding to the first 3 casing slots 14A-14C.

Figure 2:
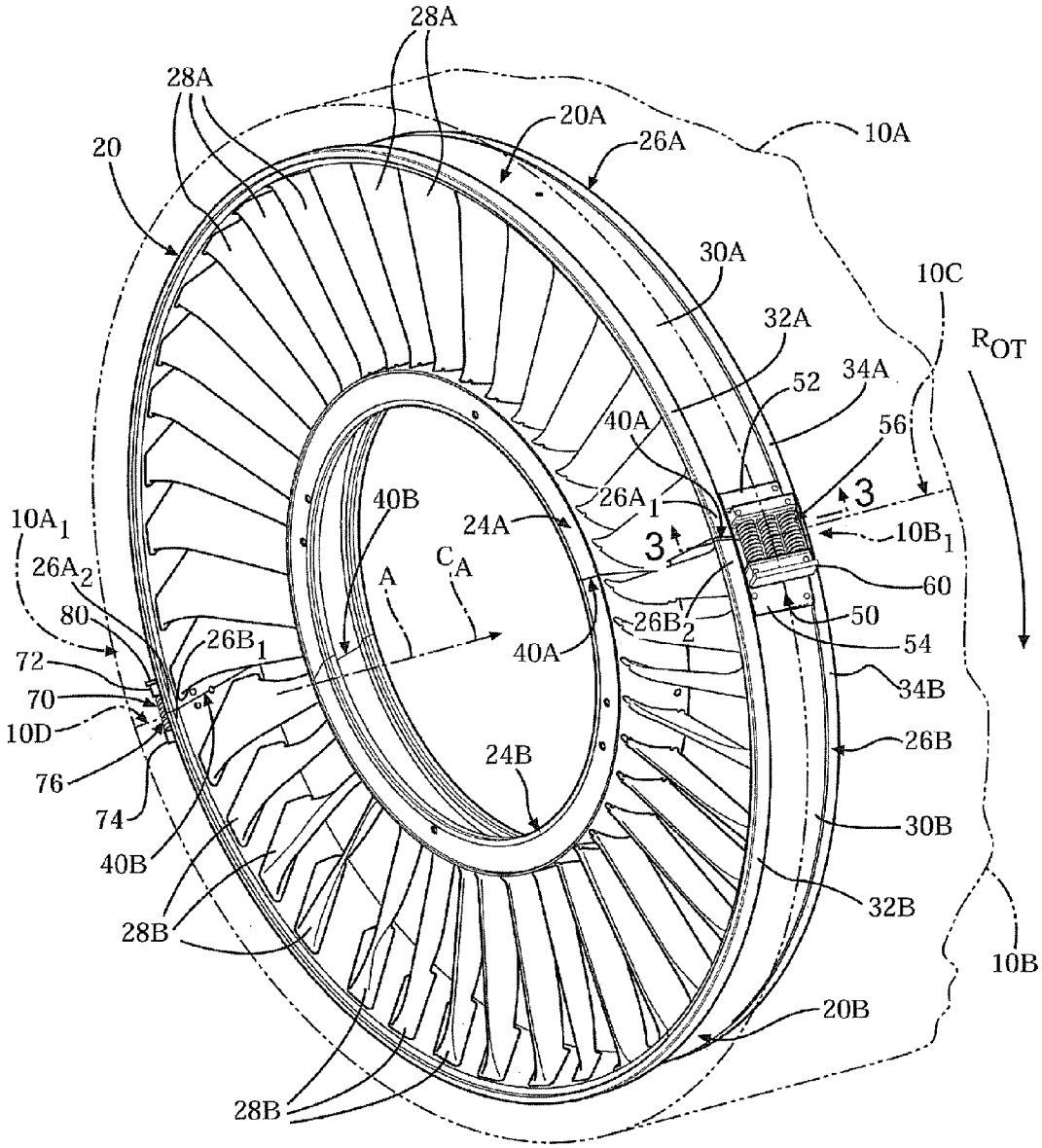
FIG. 2 is a perspective view of vane segments of the present invention and shown separate from the casing of FIG. 1.

Only the first vane segment 20 is illustrated in FIG. 2. The casing 10 is illustrated in phantom lines in FIG. 2. Each vane segment 20 is disposed coaxially about an axial centerline axis $C_A$ of an axial flow compressor, wherein the compressor forms part of the gas turbine engine, see FIG. 2.

The first vane segment 20 will now be described, it being understood that the remaining vane segments 20 may be substantially similar to the first vane segment 20 described herein. In the illustrated embodiment, the first vane segment 20 comprises a first diaphragm assembly 20A mounted within the first casing half WA and a second diaphragm assembly 20B mounted within the second casing half 10B.

Each diaphragm assembly 20A and 20B comprises a respective arcuate-shaped inner structure or shroud 24A, 24B, a respective arcuate-shaped outer structure or shroud 26A, 26B, and a plurality of airfoils 28A, 28B extending between the respective inner and outer shrouds 24A, 24B and 26A, 26B. It is noted that each diaphragm assembly 20A and 20B may comprise a single unitary structure, as illustrated in FIG. 2, or may comprise multiple segments that cooperate to define the respective diaphragm assembly 20A, 20B. For example, each multiple segment may comprise an inner shroud portion, an outer shroud portion, and a predefined number of airfoils, e.g., four airfoils.

Figure 3:
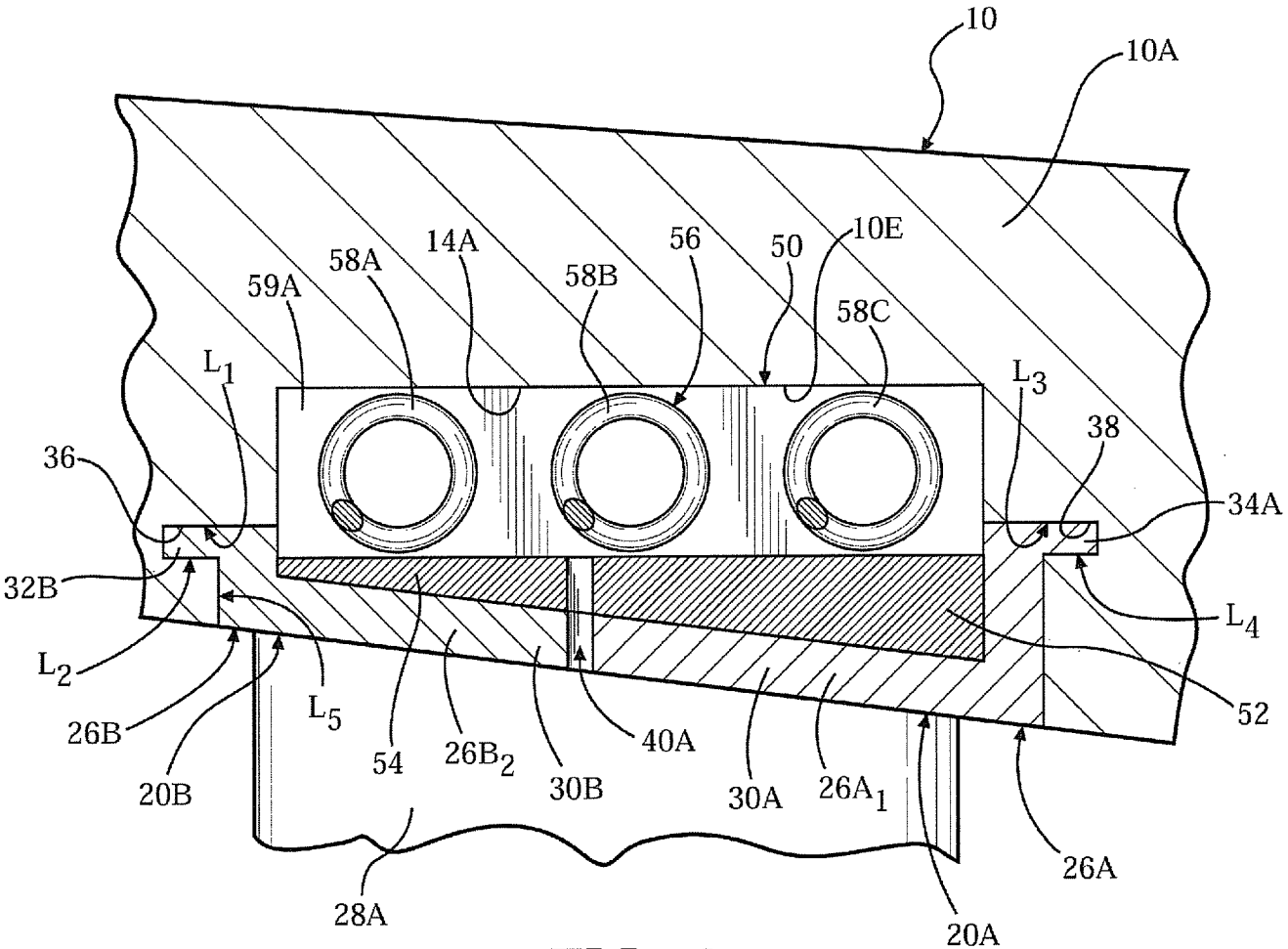
FIG. 3 is a cross sectional view taken along line 3-3 in FIG. 2, illustrating a coupling of the vane segment of FIG. 2 to the casing of FIG. 1.

FIG. 3 illustrates, partially in cross section, the circumferential first casing slot 14A in the first casing half 10A and portions of the first and second diaphragm assemblies 20A and 20B mounted within the slot 14A. A description follows regarding the geometry of the slot 14A, the construction of the first and second diaphragm assemblies 20A and 20B, and the manner in which the first and second diaphragm assemblies 20A and 20B are mounted within the slot 14A. This description is also applicable to the configuration of the diaphragm assemblies 20A and 20B of the remaining vane segments 20 mounted within the respective slots 14B and 14C.

The casing slot 14A is configured for mounting the first diaphragm assembly 20A, as well as the second diaphragm assembly 20B, via the respective outer shrouds 26A, 26B thereof in a tongue-and-groove manner for allowing ready assembly and disassembly thereof. As shown in FIG. 2, the first outer shroud 26A comprises an arcuate-shaped main body 30A and axially spaced-apart first and second hook elements 32A and 34A. The first and second hook elements 32A and 34A extend axially away from opposed sides of the main body 30A and are received in first and second grooves 36 and 38 in the casing 10, which grooves 36 and 38 define axial outer sections of the slot 14A to support the first outer shroud 26A, and, thus the first diaphragm assembly 20A within the casing 10, see FIG. 3. Similarly, the second outer shroud 26B comprises an arcuate-shaped main body 30B and axially spaced-apart first and second hook elements 32B and 34B, see FIGS. 2, 4, and 5. The first and second hook elements 32B and 34B extend axially away from opposed sides of the main body 30B and are received in the first and second grooves 36 and 38 in the casing 10 to support the second outer shroud 26B, and, thus the second diaphragm assembly 20B within the casing 10, see FIG. 3.

It is noted that first and second splitlines or lines of separation 40A and 40B (see FIGS. 2, 3, and 5) between the first and second diaphragm assemblies 20A and 20B extend substantially parallel to the angle of the airfoils 28A and 28B, and, thus, are not parallel to the first and second axial splitlines 10C and 10D between the casing halves 10A and 10B (see FIG. 2). As shown in FIG. 3, a section taken near the first splitline 10C, a small portion of the first hook element 32B of the second outer shroud 26B is received in the first groove 36 of the first casing half 10A. Similarly, a small portion of the second hook element 34A of the first outer shroud 26A is received in the second groove 38 of the second casing half 10B. At the second splitline 10D, a small portion of the first hook element 32A of the first outer shroud 26A is received in the first groove 36 of the second casing half 10B. Similarly, a small portion of the second hook element 34B of the second outer shroud 26B is received in the second groove 38 of the first casing half 10A.

Referring to FIGS. 2-5, a first energy absorbing apparatus 50 according to an embodiment of the invention is shown. The first energy absorbing apparatus 50 is disposed within the slot 14A in the casing 10 and engages a first end portion 26$A_1$ of the first outer shroud 26A and a second end portion 26$B_2$ of the second outer shroud 26B. As will be described herein, the first energy absorbing apparatus 50 absorbs at least portions of unsteady aerodynamic loads and steady rotational loads, clockwise loads as viewed in FIG. 2, generated by the first diaphragm assembly 20A.

Figure 4:
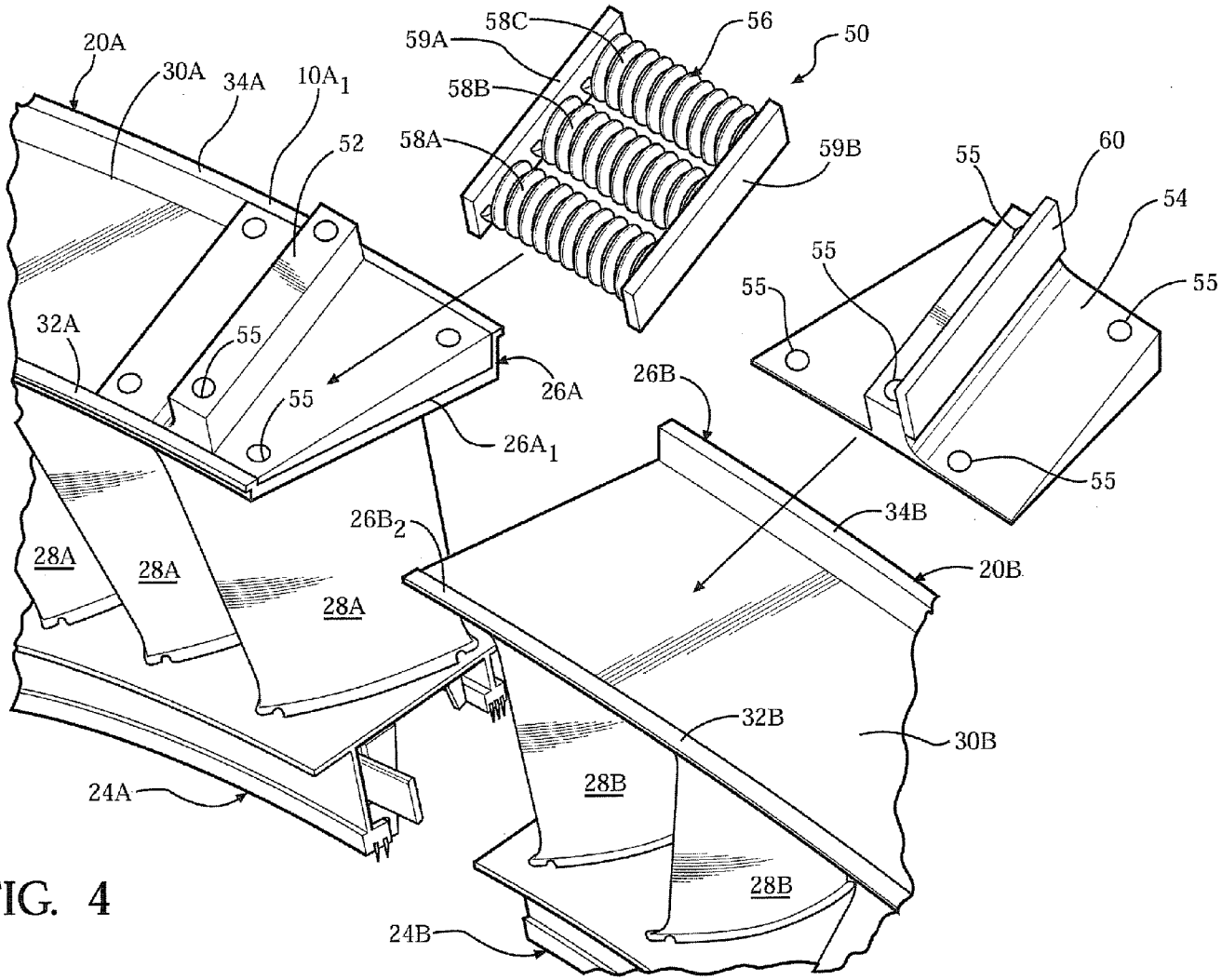
FIG. 4 is an exploded perspective view of a portion of the first vane segment of FIG. 2 and an energy absorbing apparatus according to an embodiment of the invention.
Figure 5:
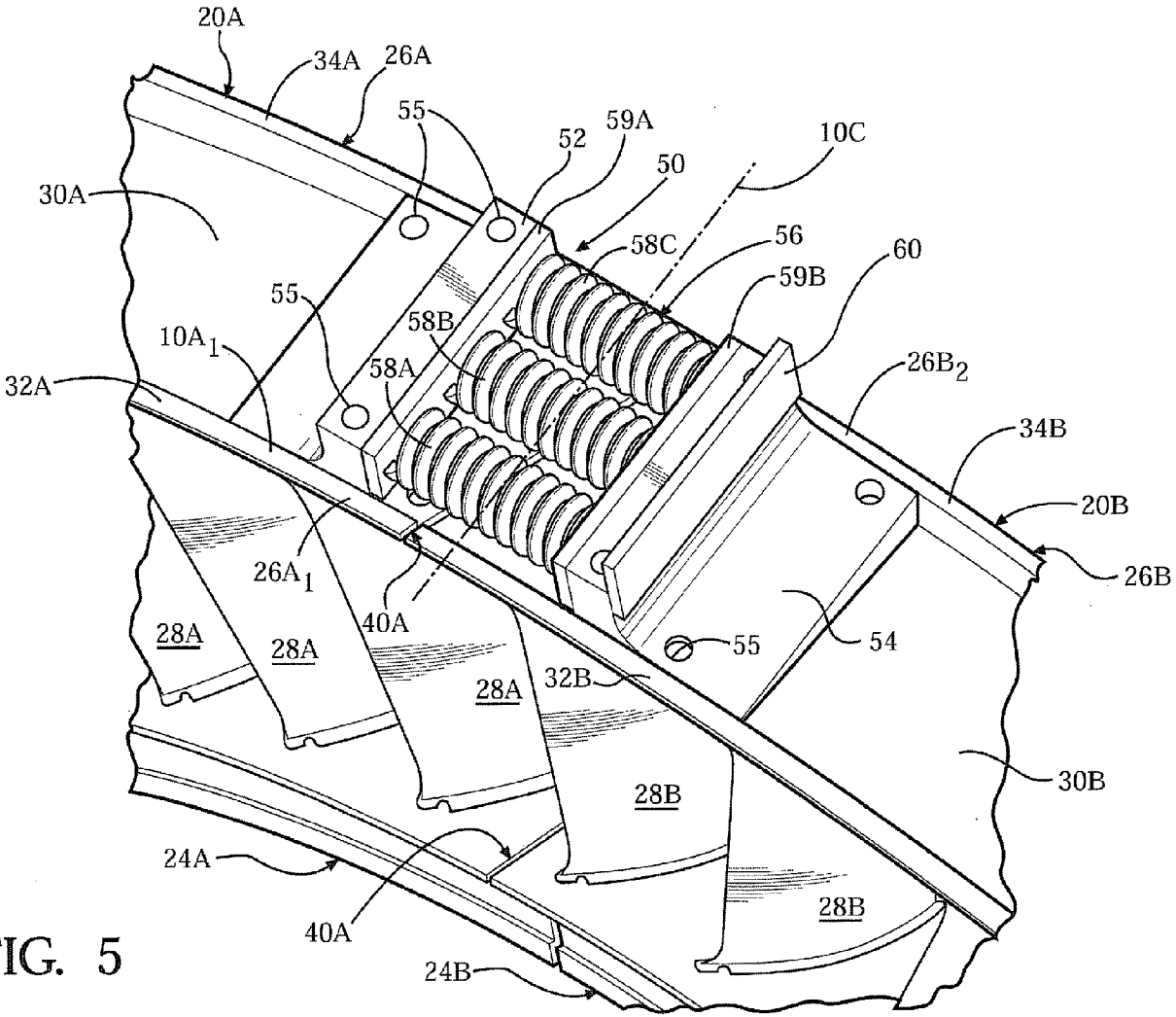
FIG. 5 is a perspective view of a portion of the first vane segment of FIG. 2 and the energy absorbing apparatus illustrated in FIG. 4.

According to this embodiment, the first energy absorbing apparatus 50 comprises a first spring support 52 coupled to the first end portion 26$A_1$ of the first outer shroud 26A, and a second spring support 54 coupled to the second end portion 26$B_2$ of the second outer shroud 26B, see FIGS. 2, 4, and 5. The first and second spring supports 52 and 54 may be affixed to their respective diaphragm assemblies 20A and 20B, for example, with pins (not shown) that are inserted through apertures 55 (see FIGS. 4 and 5) in the spring supports 52 and 54 and corresponding apertures (not shown) formed in the respective outer shrouds 26A and 26B, or by other means, such as by bolting, welding, etc.

The first energy absorbing apparatus 50 also comprises first spring structure 56 positioned between the first and second spring supports 52 and 54. The first spring structure 56 in the embodiment shown comprises first, second, and third springs 58A, 58B, and 58C, see FIGS. 3-5. The springs 58A-58C are compressed between the first and second spring supports 52 and 54 during assembly of the compressor casing 10 so as to create a separational force between the first and second diaphragm assemblies 20A and 20B, as will be discussed herein. It is noted that any suitable number of springs could be used for the first spring structure 56. It is also contemplated that the spring structure 56 could be enclosed in a housing (not shown), wherein the housing could provide lubrication for the springs 58A-58C and increase the durability of the springs 58A-58C. It is further noted that other types of structures could be used in place of the coil springs 58A-58C, such as, for example, stacked spring washers, Belleville springs, hydraulic dampers, etc.

In the embodiment shown, the springs 58A-58C are held in position between the first and second spring supports 52 and 54 via a casing wall 10E defining the casing slot 14A. Moreover, in the embodiment shown, first and second plate members 59A and 59B (see FIGS. 4 and 5) of the first spring structure 76 are affixed to respective ends of the springs 58A-58C, which plate members 59A and 59B link the springs 58A-58C together to form an integral first spring structure 56 comprising the springs 58A-58C and the plate members 59A and 59B. It is contemplated that the first spring structure 56 could be designed without the plate members 59A and 59B, such that the springs 58A-58C could directly contact the first and second spring supports 52 and 54.

Figure 6:
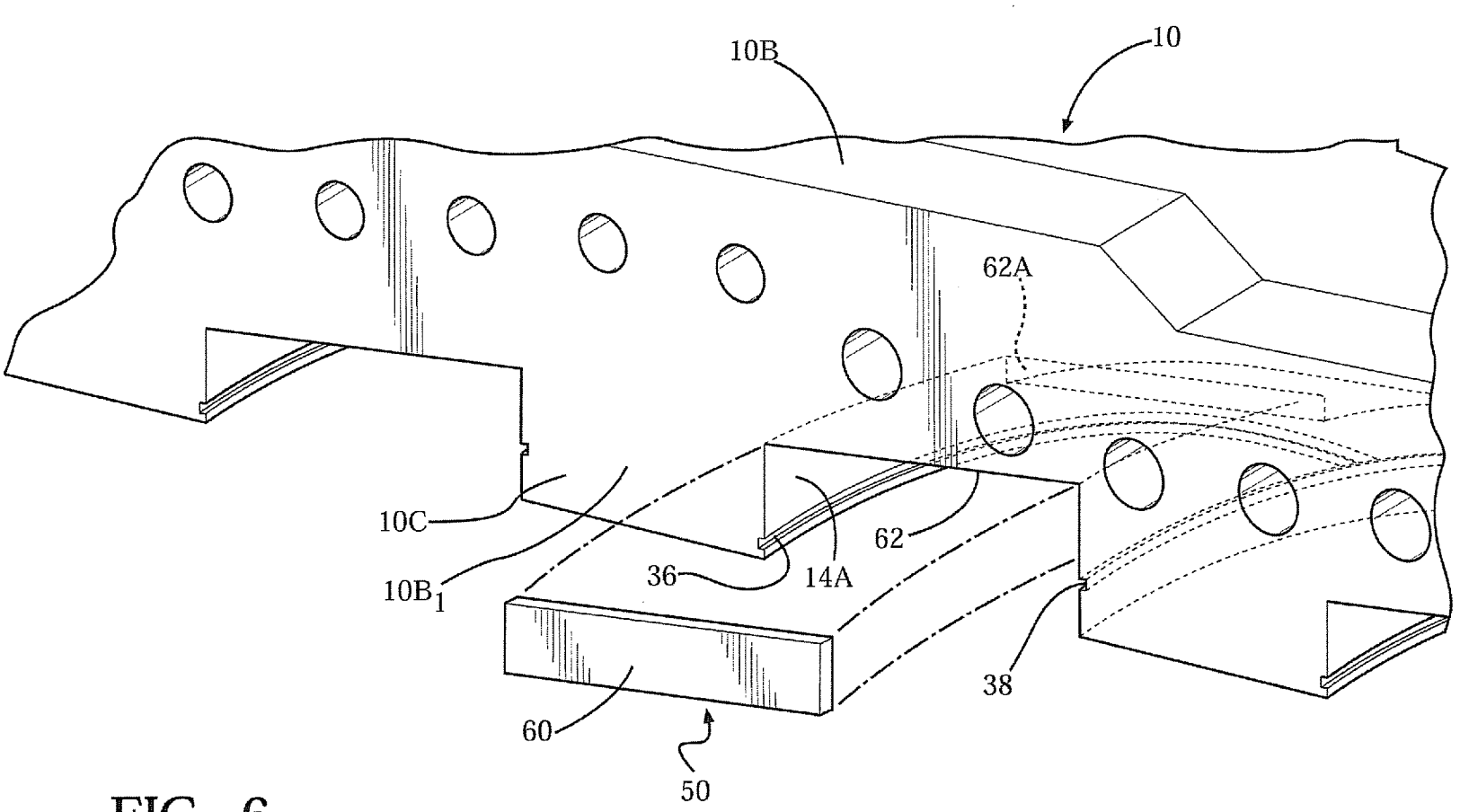
FIG. 6 is an exploded perspective view of a portion of the casing of FIG. 1 and a spring support plate according to an embodiment of the invention.

Referring to FIGS. 4-6, the first energy absorbing apparatus 50 according to this embodiment further comprises a first spring support plate 60, which spring support plate 60 is rigidly fixed to the second spring support 54 and extends radially outwardly further than the second spring support 54 in the embodiment shown. During assembly of the compressor, the spring support plate 60 is slidably received in a circumferentially and radially extending slot 62 located at a first end portion 10$B_1$ of the second casing half 10B adjacent to and radially outwardly of the slot 14A, as shown in FIG. 6. The spring support plate 60 is received in the slots 14A and 62 during assembly of the compressor and abuts a wall portion 62A defining an end section of the slot 62, see FIG. 6, as will be described herein. Hence, during operation of the compressor, the first spring support plate 60 prevents the second spring support 54, and, thus, the second diaphragm assembly 20B, from rotating clockwise in the slot 14A, as will be discussed herein.

A second energy absorbing apparatus 70 according to an embodiment of the invention is shown in FIG. 2. The second energy absorbing apparatus 70 is disposed within the slot 14A in the casing 10 and engages a second end portion 26$A_2$ of the first outer shroud 26A and a first end portion 26$B_1$ of the second outer shroud 26B. As will be described herein, the second energy absorbing apparatus 70 absorbs at least portions of unsteady aerodynamic loads and steady rotational loads, clockwise loads as viewed in FIG. 2, generated by the second diaphragm assembly 20B.

The second energy absorbing apparatus 70 comprises a third spring support 72 coupled to the second end portion 26$A_2$ of the first outer shroud 26A, and a fourth spring support 74 coupled to the first end portion 26$B_1$ of the second outer shroud 26B, see FIG. 2. The second energy absorbing apparatus 70 also comprises second spring structure 76 positioned between the third and fourth spring supports 72 and 74.

Similar to the first energy absorbing apparatus 50, the second energy absorbing apparatus 70 further comprises a second spring support plate 80, see FIG. 2. The spring support plate 80 is rigidly affixed to the third spring support 72 and extends radially outwardly further than the third spring support 72 in the embodiment shown. During assembly of the compressor, the spring support plate 80 is slidably received in a circumferentially and radially extending slot 82 located at a first end portion 10$A_1$ of the first casing half 10A adjacent to and radially outwardly of the slot 14A, see FIG. 1. The second spring support plate 80 is received in the slot 14A during assembly of the compressor and abuts a wall portion 82A defining an end section of the slot 82, see FIG. 1, as will be described herein. Hence, during operation of the compressor, the second spring support plate 80 prevents the third spring support 72, and, thus, the first diaphragm assembly 20A, from rotating clockwise in the slot 14A, as will be discussed herein.

The remaining structure of the second energy absorbing apparatus 70 is substantially similar to that of the first energy absorbing apparatus 50 and, thus, will not be described in detail herein.

It is noted that, the end portions 26$A_1$ and 26$B_1$ of the outer shrouds 26A and 26B that do not include a spring support plate 60 or 80 affixed to their respective spring supports 52 and 74 are referred to herein as the "free ends" of the respective diaphragm assemblies 20A and 20B, and the end portions 26$A_2$ and 26$B_2$ of the outer shrouds 26A and 26B that include a spring support plate 60 or 80 affixed to their respective spring supports 54 and 72 are referred to herein as the "fixed ends" of the respective diaphragm assemblies 20A and 20B.

During assembly of the compressor, the first, second, third and fourth spring supports 52, 54, 72, 74 are affixed to the respective diaphragm assemblies 20A and 20B. The first vane segment 20 is then circumferentially inserted into the casing 10 by inserting the free ends of the diaphragm assemblies 20A and 20B into the corresponding casing halves 10A and 10B, i.e., the first and second hook elements 32A, 32B and 34A, 34B are slid into the respective first and second grooves 36 and 38 in the casing halves 10A and 10B. The diaphragm assemblies 20A and 20B are circumferentially inserted into the casing halves 10A and 10B until the spring support plates 60 and 80 contact the respective wall portions 62A and 82A. The second and third vane segments 20 are assembled in a similar manner into the slots 14B and 14C of the casing 10, and any other static airfoil stages in the compressor may be similarly assembled.

After the first, second, and third vane segments 20, e.g., the first and second diaphragm assemblies 20A and 20B of the first vane segment 20, and any other static airfoil stages in the compressor have been installed into the casing 10, the spring structures 56 and 76 for each of the first, second, and third vane segments 20 (and any other static airfoil stages in the compressor) are installed into the lower casing half, i.e., the second casing half 10B in the embodiment shown, by placing the spring structures 56 and 76 onto the second and fourth spring supports 54 and 74 of the respective energy absorbing apparatuses 50 and 70. The upper casing half, i.e., the first casing half 10A in the embodiment shown, is then installed onto the lower casing half 10B. The weight of the upper casing half 10A compresses the springs 58A-58C of the spring structures 56 and 76, thus producing a separational force between the first and second diaphragm assemblies 20A and 20B. The casing halves 10A and 10B are then suitably fastened together, such as by bolting.

During operation, air travels through the compressor in the direction of arrow A, as shown in FIGS. 1 and 2. For each of the first, second, and third vane segments 20, (and any other static airfoil stages in the compressor), there is a corresponding set of rotatable blades (not shown). As the air flows through the compressor, it is compressed in turn by each succeeding set of blades for elevating the pressure of the air. The first, second, and third vane segments 20 (and any other static airfoil stages in the compressor) comprise stationary flowpath components or stators, which direct airflow through the compressor. The airflow experiences an increase in pressure as it passes through each stator.

As the air flows through the airfoils 28A, 28B of the first, second, and third vane segments 20 (and any other static airfoil stages in the compressor), each diaphragm assembly 20A, 20B experiences axial and tangential loads of a steady nature caused by a difference in pressure across the each vane segment 20 and the airflow impinging on the corresponding airfoils 28A and 28B. Additionally, there are airfoil-passing aerodynamic excitation loads of a pulsating nature. Together, these loads cause the rows of airfoils 28A and 28B and, thus, correspondingly, the outer shroud 26A, 26B of each diaphragm assembly 20A, 20B, to vibrate.

The energy absorbing apparatuses 50 and 70 in each of the first, second, and third vane segments 20 (and any other static airfoil stages in the compressor) dampen these vibrations and, hence, absorb at least a portion of the unsteady aerodynamic excitation loads, i.e., via the separational force provided by the spring structures 56 and 76. Hence, very little frictional movement occurs between the diaphragm assemblies 20A and 20B and the engine casing 10, which is believed to reduce the amount of wear between diaphragm assemblies 20A and 20B and the engine casing 10. Specifically, in prior art designs, it has been found that a large amount of frictional wear occurs at locations $L_1$, $L_2$, $L_3$, $L_4$, and $L_5$ illustrated in FIG. 3, especially at the free ends of the diaphragm assemblies 20A and 20B, at least in part as a result of the vibration of the diaphragm assemblies 26A, 26B and the resulting frictional movement between the diaphragm assemblies 20A and 20B and the engine casing 10. The damping provided by the energy absorbing apparatuses 50 and 70 is believed to result in less wear at these locations $L_1$, $L_2$, $L_3$, $L_4$, and $L_5$ by reducing the vibration frequency, and, thus, reducing the frictional wear between these components, most notably at the locations $L_1$, $L_2$, $L_3$, $L_4$, and $L_5$ at the free ends of the diaphragm assemblies 20A and 20B.

The energy absorbing apparatuses 50 and 70 also effectively tie the first and second diaphragm assemblies 20A and 20B together, which is believed to improve load distribution on the first and second hook elements 32A, 32B and 34A, 34B and reduce movement of the end portions 26$A_1$, 26$A_2$, 26$B_1$, 26$B_2$ of the first and second outer shrouds 26A and 26B. The improved load distribution and reduction of movement of the end portions 26$A_1$, 26$A_2$, 26$B_1$, 26$B_2$ are believed to further reduce wear between the diaphragm assemblies 20A and 20B and the engine casing 10 at the locations $L_1$, $L_2$, $L_3$, $L_4$, and $L_5$ by limiting the movement between these components, which reduces frictional contact therebetween.

Moreover, the spring structures 56 and 76 of the energy absorbing apparatuses 50 and 70 are compressed during operation of the engine so as to absorb steady rotational loads of the first and second diaphragm assemblies 20A and 20B. That is, as the air flows through the compressor, the air imparts a steady rotational force on the airfoils 28A and 28B of the respective first and second diaphragm assemblies 20A and 20B of the first, second, and third vane segments 20, (and any other static airfoil stages in the compressor), in the direction of the arrow $R_{OT}$ in FIG. 2, i.e., the clockwise direction as viewed in FIG. 2. These steady rotational loads cause the first and second diaphragm assemblies 20A and 20B to want to rotate in the clockwise direction. However, the contact between the first spring support plates 60 and the second spring support 54 of each energy absorbing apparatus 50 and the contact between the second spring support plates 80 and the third spring support 72 of each energy absorbing apparatus 70 prevents rotational movement of the first and second diaphragm assemblies 20A and 20B in the direction $R_{OT}$ by creating structural stops for the diaphragm assemblies 20A and 20B within the casing 10. As the first and second diaphragm assemblies 20A and 20B try to move circumferentially, the spring structures 56 and 76 of the energy absorbing apparatuses 50 and 70 are compressed to absorb a portion of the steady circumferential loads of the first and second diaphragm assemblies 20A and 20B.

Further, the spring structures 56 and 76 of the energy absorbing apparatuses 50 and 70 provide a separational force between the first and second diaphragm assemblies 20A and 20B to prevent or reduce contact therebetween. Hence, very little or no wear occurs between the first and second diaphragm assemblies 20A and 20B.

The reduction in the wear of the components discussed herein is believed to increase component life, and, thus prevent or reduce the need for repairs of these components.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A gas turbine comprising:

a casing having a radially outer surface and a radially inner surface comprising an annular slot extending circumferentially therein;

a first diaphragm assembly comprising a first inner structure, a first outer structure, and a plurality of airfoils extending between said first inner and outer structures;

a second diaphragm assembly comprising a second inner structure, a second outer structure, and a plurality of airfoils extending between said second inner and outer structures; and first energy absorbing apparatus engaging a first end portion of said first outer structure so as to absorb at least portions of unsteady aerodynamic loads and steady rotational loads generated by said first diaphragm assembly, said first energy absorbing apparatus comprising:

a first spring support coupled to said first end portion of said first outer structure of said first diaphragm assembly;

a second spring support coupled to a second end portion of said second outer structure of said second diaphragm assembly; and first spring structure extending from said first spring support to said second spring support.

2. The gas turbine of claim 1, further comprising a second energy absorbing apparatus comprising:

a third spring support coupled to a second end portion of said first outer structure of said first diaphragm assembly;

a fourth spring support coupled to a first end portion of said second outer structure of said second diaphragm assembly; and second spring structure positioned between said third and fourth spring supports.

3. The gas turbine of claim 1, wherein said first energy absorbing apparatus further comprises:

a spring support plate coupled to said second spring support of said first energy absorbing apparatus, said spring support plate abutting said casing to prevent rotation of said first energy absorbing apparatus within said annular slot.

4. The gas turbine of claim 3, wherein said casing comprises first and second casing halves, said spring support plate abutting a first end portion of said second casing half.

5. The gas turbine of claim 1, wherein said first energy absorbing apparatus is disposed within said slot in said casing.

6. The gas turbine of claim 1, wherein said first energy absorbing apparatus substantially prevents said first end portion of said first outer structure of said first diaphragm assembly from contacting said second end portion of said second outer structure of said second diaphragm assembly.

7. The gas turbine of claim 1, wherein said first spring structure is compressed between said first and second spring supports during assembly so as to create a separational force between said first and second diaphragm assemblies.

8. The gas turbine of claim 7, wherein said first spring structure comprises at least one coil spring.

9. A gas turbine comprising:

a casing having a radially outer surface and a radially inner surface comprising an annular slot extending circumferentially therein;

a first diaphragm assembly comprising a first inner structure, a first outer structure and a plurality of airfoils extending between said first inner and outer structures;

a second diaphragm assembly comprising a second inner structure, a second outer structure and a plurality of airfoils extending between said second inner and outer structures;

first energy absorbing apparatus engaging a first end portion of said first outer structure so as to absorb at least portions of unsteady aerodynamic loads and steady rotational loads generated by said first diaphragm assembly, wherein said first energy absorbing apparatus substantially prevents said first end portion of said first outer structure of said first diaphragm assembly from contacting a second end portion of said second outer structure of said second diaphragm assembly; and second energy absorbing apparatus engaging a first end portion of said second outer structure so as to absorb at least portions of unsteady aerodynamic loads and steady rotational loads generated by said second diaphragm assembly, wherein said second energy absorbing apparatus substantially prevents said first end portion of said second outer structure of said second diaphragm assembly from contacting a second end portion of said first outer structure of said first diaphragm assembly.

10. The gas turbine of claim 9, wherein said first energy absorbing apparatus comprises:

a first spring support coupled to said first end portion of said first outer structure of said first diaphragm assembly;

a second spring support coupled to said second end portion of said second outer structure of said second diaphragm assembly; and first spring structure positioned between said first and second spring supports.

11. The gas turbine of claim 10, wherein said second energy absorbing apparatus comprises:

a third spring support coupled to said second end portion of said first outer structure of said second diaphragm assembly;

a fourth spring support coupled to said first end portion of said second outer structure of said second diaphragm assembly; and second spring structure positioned between said third and fourth spring supports.

12. The gas turbine of claim 11, wherein:

said first spring structure is compressed between said first and second spring supports during assembly so as to create a separational force between said first and second diaphragm assemblies; and said second spring structure is compressed between said third and fourth spring supports during assembly so as to create a separational force between said first and second diaphragm assemblies.

13. The gas turbine of claim 12, wherein said first and second spring structures each comprise at least one coil spring.

14. The gas turbine of claim 10, further comprising a first spring support plate coupled to said second spring support of said first energy absorbing apparatus, said first spring support plate abutting said casing to prevent rotation of said first energy absorbing apparatus within said annular slot.

15. The gas turbine of claim 14, further comprising a second spring support plate coupled to said first spring support of said second energy absorbing apparatus, said second spring support plate abutting said casing to prevent rotation of said second energy absorbing apparatus within said annular slot.

16. A gas turbine comprising:

a casing having a radially outer surface and a radially inner surface comprising an annular slot extending circumferentially therein;

a first diaphragm assembly comprising a first inner structure, a first outer structure and a plurality of airfoils extending between said first inner and outer structures;

a second diaphragm assembly comprising a second inner structure, a second outer structure and a plurality of airfoils extending between said second inner and outer structures;

first energy absorbing apparatus engaging a first end portion of said first outer structure so as to absorb at least portions of unsteady aerodynamic loads and steady rotational loads generated by said first diaphragm assembly, said first energy absorbing apparatus comprising:

a first spring support coupled to said first end portion of said first outer structure of said first diaphragm assembly;

a second spring support coupled to a second end portion of said second outer structure of said second diaphragm assembly; and first spring structure extending between said first and second spring supports; and second energy absorbing apparatus engaging a first end portion of said second outer structure so as to absorb at least portions of unsteady aerodynamic loads and steady rotational loads generated by said second diaphragm assembly, said second energy absorbing apparatus comprising:

a third spring support coupled to a second end portion of said first outer structure of said first diaphragm assembly;

a fourth spring support coupled to said first end portion of said second outer structure of said second diaphragm assembly; and second spring structure extending between said third and fourth spring supports.

17. The gas turbine of claim 16, further comprising a first spring support plate coupled to said first energy absorbing apparatus, said first spring support plate abutting said casing to prevent rotation of said first energy absorbing apparatus within said annular slot.

18. The gas turbine of claim 17, further comprising a second spring support plate coupled to said second energy absorbing apparatus, said second spring support plate abutting said casing to prevent rotation of said second energy absorbing apparatus within said annular slot.

19. The gas turbine of claim 16, wherein:

said first spring structure is compressed between said first and second spring supports during assembly so as to create a separational force between said first and second diaphragm assemblies; and said second spring structure is compressed between said third and fourth spring supports during assembly so as to create a separational force between said first and second diaphragm assemblies.

20. The gas turbine of claim 19, wherein said first and second spring structures each comprise at least one coil spring.

* * * * *